US012446718B2

(12) United States Patent
Zadęcki

(10) Patent No.: US 12,446,718 B2
(45) Date of Patent: Oct. 21, 2025

(54) TELESCOPIC PAPER DRINKING STRAW

(71) Applicant: International Tobacco Machinery Poland Sp. z o. o., Radom (PL)

(72) Inventor: Robert Zadęcki, Radom (PL)

(73) Assignee: International Tobacco Machinery Poland Sp. z o. o., Radom (PL)

( * ) Notice: Subject to any disclaimer, the term of this patent is extended or adjusted under 35 U.S.C. 154(b) by 422 days.

(21) Appl. No.: 17/995,712

(22) PCT Filed: Apr. 28, 2021

(86) PCT No.: PCT/EP2021/061135
§ 371 (c)(1),
(2) Date: Oct. 7, 2022

(87) PCT Pub. No.: WO2021/219718
PCT Pub. Date: Nov. 4, 2021

(65) Prior Publication Data

US 2023/0140521 A1 May 4, 2023

(30) Foreign Application Priority Data

Apr. 28, 2020 (EP) ..... 20171882
Nov. 13, 2020 (EP) ..... 20207512

(51) Int. Cl.
*A47G 21/18* (2006.01)

(52) U.S. Cl.
CPC ..... *A47G 21/189* (2013.01)

(58) Field of Classification Search
CPC ..... A47G 21/18; A47G 21/189
(Continued)

(56) References Cited

U.S. PATENT DOCUMENTS 4,657,182 A * 4/1987 Hoshi ..... A47G 21/189 239/33
4,736,887 A * 4/1988 Inaba ..... A47G 21/189 239/33

(Continued)

FOREIGN PATENT DOCUMENTS

CN 209995845 U 1/2020
CN 210540587 U 5/2020

(Continued)

OTHER PUBLICATIONS

International Search Report mailed Aug. 25, 2021 in International Patent Application No. PCT/EP2021/061135.

(Continued)

*Primary Examiner* — Steven J Ganey
(74) *Attorney, Agent, or Firm* — Oppedahl Patent Law Firm LLC

(57) ABSTRACT

The object of the application is a telescopic paper drinking straw comprising: a first straw with a first outer diameter, a second straw with a second inner diameter, the first straw with the first outer diameter being situated at least partly inside the straw having the second inner diameter, coaxially with the straw having the second inner diameter, characterised in that the first straw has at least two locking elements protruding from the outer surface of the first straw, and the second straw has at least two locking elements protruding from the inner surface of the second straw.

16 Claims, 7 Drawing Sheets

(58) Field of Classification Search
USPC ..... 239/33
See application file for complete search history.

(56) References Cited

U.S. PATENT DOCUMENTS

| | | | | | |
|---|---|---|---|---|---|
| 4,850,533 | A * | 7/1989 | Hoshi | A47G 21/189 | 239/33 |
| 5,820,023 | A * | 10/1998 | Kristensson | B65D 77/28 | 239/33 |
| 11,653,778 | B2 * | 5/2023 | Chen | A47G 21/189 | 239/33 |
| 2011/0057050 | A1 | 3/2011 | Shakur-Jenkins | | |
| 2021/0345804 | A1 * | 11/2021 | Chen | A47G 21/189 | |

FOREIGN PATENT DOCUMENTS

| | | | |
|---|---|---|---|
| CN | 211632704 | U | 10/2020 |
| DE | 3427732 | A1 | 3/1986 |
| DE | 20309272 | U1 | 9/2003 |
| EP | 3698679 | A1 | 8/2020 |
| JP | S63109823 | A | 5/1988 |
| PL | 209061 | B | 7/2011 |

OTHER PUBLICATIONS

International Preliminary Report on Patentability under Chapter II mailed Nov. 3, 2021 in International Patent Application No. PCT/EP2021/061135.

* cited by examiner

TELESCOPIC PAPER DRINKING STRAW

The object of the invention is a telescopic paper drinking straw.

The invention relates to beverage drinking straws, in particular telescopic straws made of biodegradable materials such as paper.

In the food industry, straws which are usually made of plastic and pose a serious threat to ecosystems due to their long decay period of up to 200 years are used to drink various kinds of beverages. These may be both one-part and two-part straws, straight straws or bent straws. Plastic straws are made as one straight element or as an element having an articulated part allowing to bend it. Two-part straws usually have in their structure a lock connecting both parts so that after inserting one part into the other a beverage may be consumed with an already assembled straw without a fear that the connection will be leaky. Such connection allows taking a straw off, for example before wrapping the straw into a foil from which the straw is removed before consuming a beverage and which is unfolded to its maximum length. Such straws are referred to as telescopic straws.

Telescopic drinking straws, in particular made of plastic materials, are known in the prior art.

From the document EP0139074A is known a telescopic drinking straw provided with an outer straw and an inner straw. The inner straw has an extended part at the base, while the outer straw is narrowed at its tip. Transitions between the diameters are in both cases gradual so that the straws have a conical shape. The outer straw is provided with a part having a slightly reduced diameter, and the inner straw is provided with a part having a slightly increased diameter so that in an unfolded configuration the part with increased diameter of the inner straw overlaps the part with reduced diameter of the outer straw.

The publication DE20309272U1 disclosed a telescopic straw provided with an outer straw with embossing directed to the inside of the outer straw and an inner straw provided with embossing directed to the inside of the inner straw. Due to the corresponding shape of the embossing, the embossing of the outer straw adapts to the embossing in the inner straw and fixes the inner straw inside the outer straw.

In the publication U.S. Pat. No. 4,657,182 is disclosed a telescopic straw in which the inner straw is provided with an extension at one end, and the outer straw is successively clamped on the inner straw to form a unit preventing the inner straw from sliding out.

The object of the invention is a telescopic paper drinking straw comprising: a first straw with a first outer diameter, a second straw with a second inner diameter, whereas the straw with the first outer diameter is situated at least partly inside the straw with the second inner diameter, coaxially with the straw with the second inner diameter. The straw according to the invention is characterised in that the first straw has at least two locking elements protruding from the outer surface of the first straw, and the second straw has at least two locking elements protruding from the inner surface of the second straw.

The paper straw according to the invention is characterised in that at least two locking elements protruding from the inner surface of the second straw are arranged at a distance of at least half the diameter of the first straw.

The paper straw according to the invention is characterised in that at least two locking elements protruding from the outer surface of the first straw are arranged at a distance of at least half the diameter of the first straw.

The paper straw according to the invention is characterised in that the distance between the first and second locking elements on the first and second straw, respectively, is at least 2 mm.

The paper straw according to the invention is characterised in that the locking elements have the form of ring-shaped embosses.

The paper straw according to the invention is characterised in that the locking elements have different height or width.

The paper straw according to the invention is characterised in that the locking elements are adapted to form a seal of a telescopic joint.

The paper straw according to the invention is characterised in that at least one locking element on the first straw is situated at a distance of at least half the diameter of the first straw from one of its ends.

The paper straw according to the invention is characterised in that at least one locking element on the second straw is situated at a distance of at least half the diameter of the second straw from one of its ends.

The paper straw according to the invention is characterised in that the inner diameter of the second straw at one end is smaller than the outer diameter of the first straw.

The paper straw according to the invention is characterised in that at least two locking elements of the first straw and at least two locking elements of the second straw are arranged at a distance corresponding to the diameter of the first straw.

The paper straw according to the invention is characterised in that the distance between the locking elements of the first straw is greater than the width of the locking element of the second straw, and the distance between the locking elements of the second straw is greater than the width of the locking element of the first straw.

The paper straw according to the invention is characterised by having two configurations, whereas in the first configuration the first straw is substantially inside the second straw, and a part of the first straw protrudes from the second straw allowing pulling the first straw out of the second straw, while in the second configuration the first straw is substantially pulled out of the second straw so that at least one locking element of the first straw is situated between the locking elements of the second straw, or at least one locking element of the second straw is situated between the locking elements of the first straw.

The paper straw according to the invention is characterised in that in the second configuration, in the first working position, one of the locking elements of the first straw is situated between the locking elements of the second straw, and in the second working position the second locking element of the first straw is situated between the locking elements of the second straw.

The paper straw according to the invention is characterised in that, in the second configuration, the lateral surface of at least one locking element of the first straw protruding from the external surface of the first straw is in contact with the lateral surface of at least one element protruding from the internal surface of the second straw.

An advantage of the paper telescopic straw is its biodegradability. Moreover, advantageous features of the telescopic joint ensure that the telescopic straw maintains its axial stability in the unfolded configuration. Another advantage of the telescopic straw according to the invention is that during unfolding the user clearly feels the moment when the first locking elements squeeze through and may easily stop the unfolding movement, at the same time retaining the possibility to unfold the straw completely if necessary. Moreover, the straw according to the invention minimizes the material consumption while maintaining the axial stability, and also improves the safety of use because in case of an accident the straw folds to minimum dimensions.

The object of the invention is shown in detail in a preferred embodiment in a drawing in which.

Figure 5A:
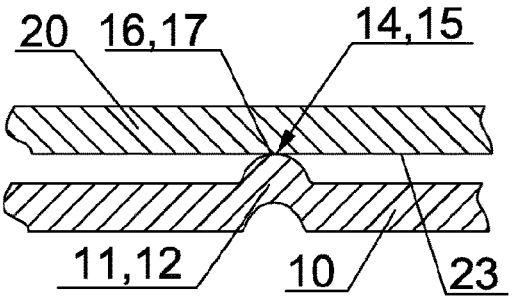
Figure 5B:
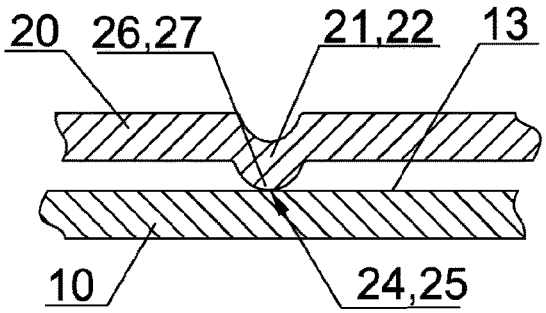
Figure 6A:
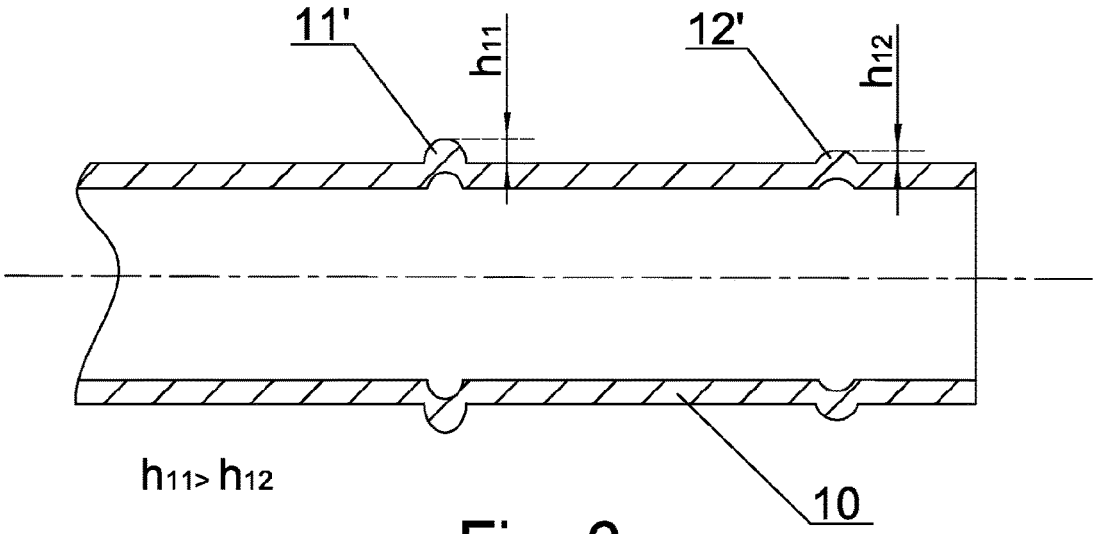
Figure 6B:
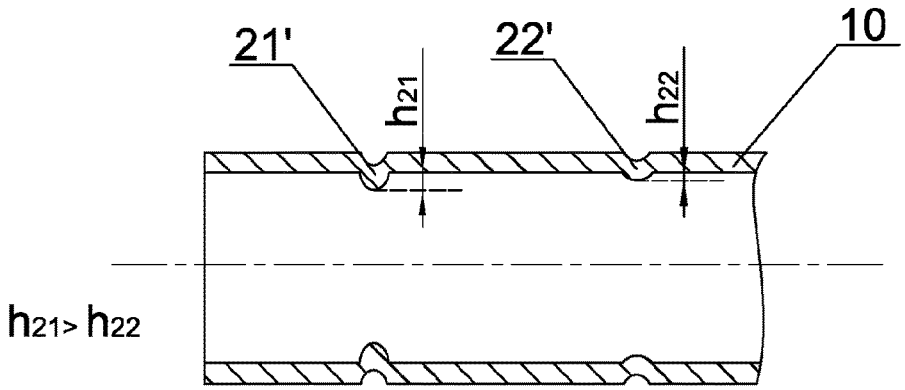
Figure 6C:
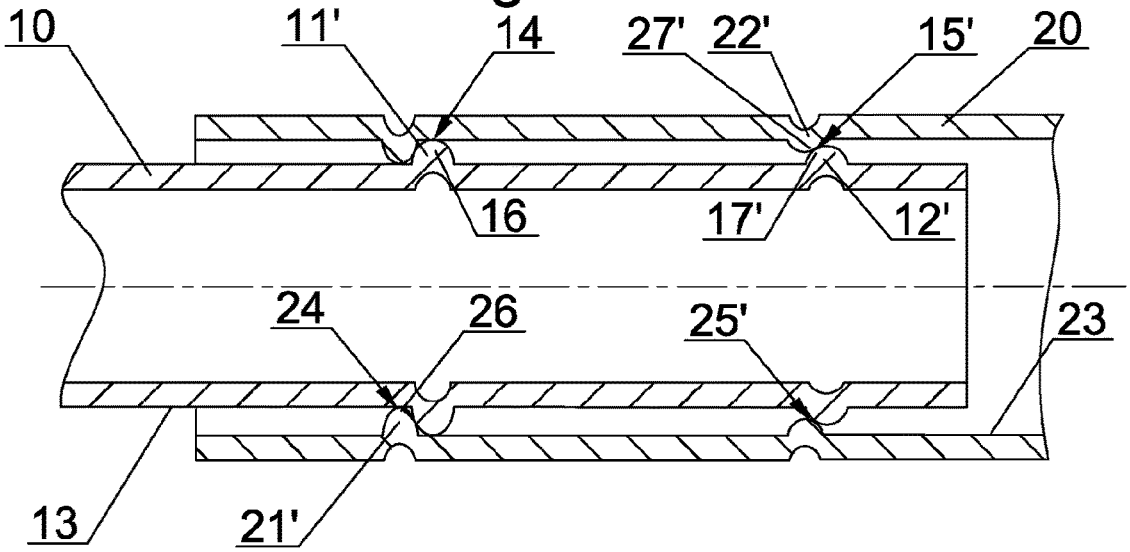
Figure 7A:
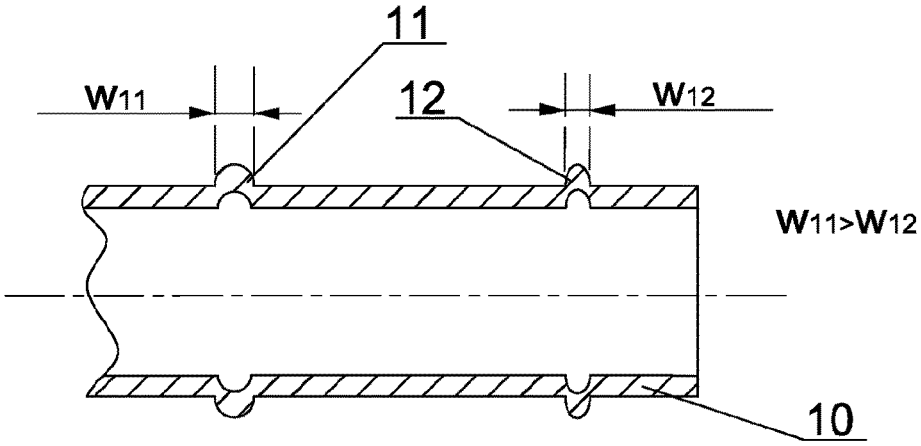
Figure 7B:
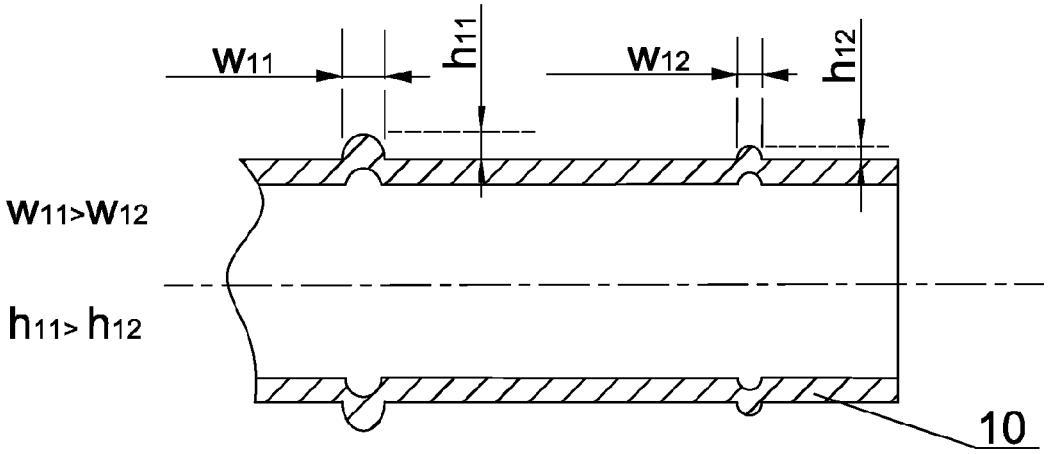
Figure 8A:
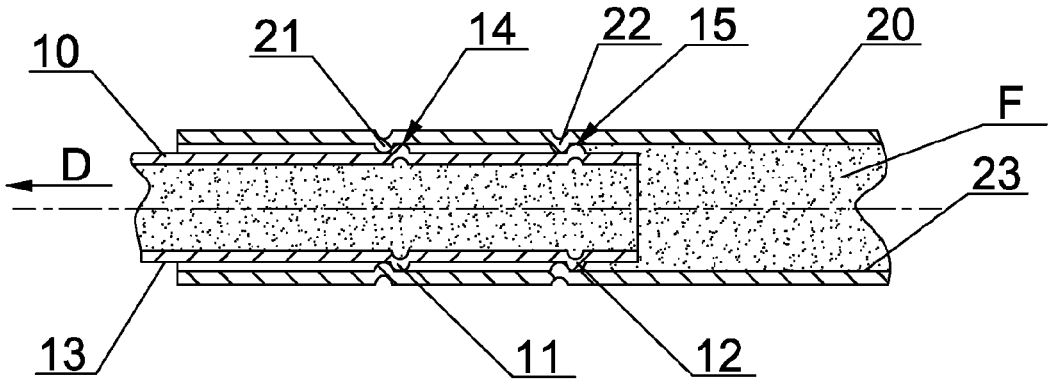
Figure 8B:
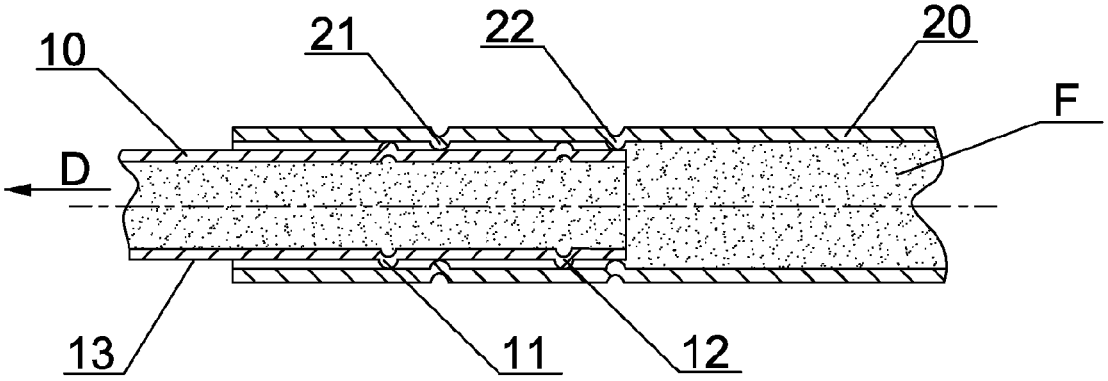
Figure 8C:
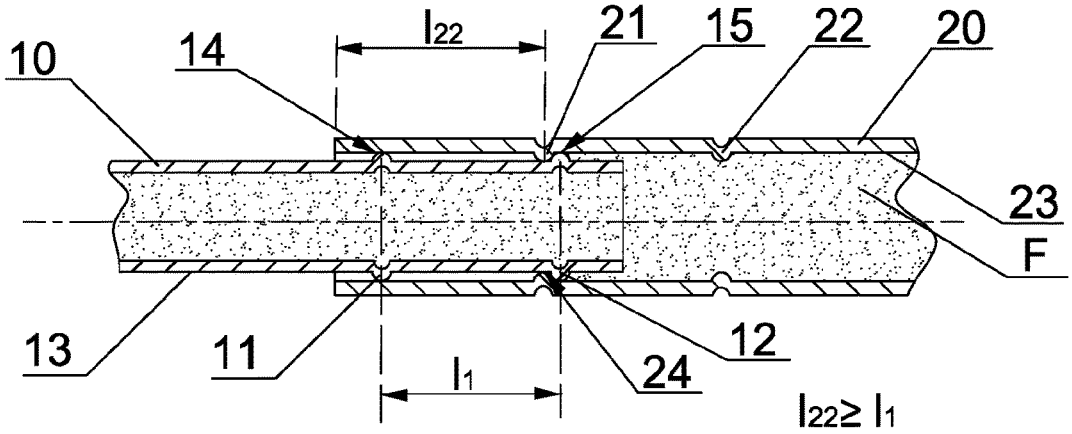
Figure 9:
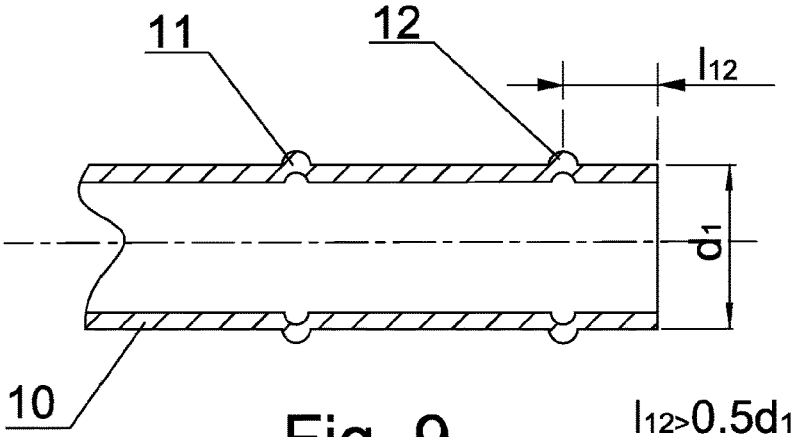
Figure 10A:
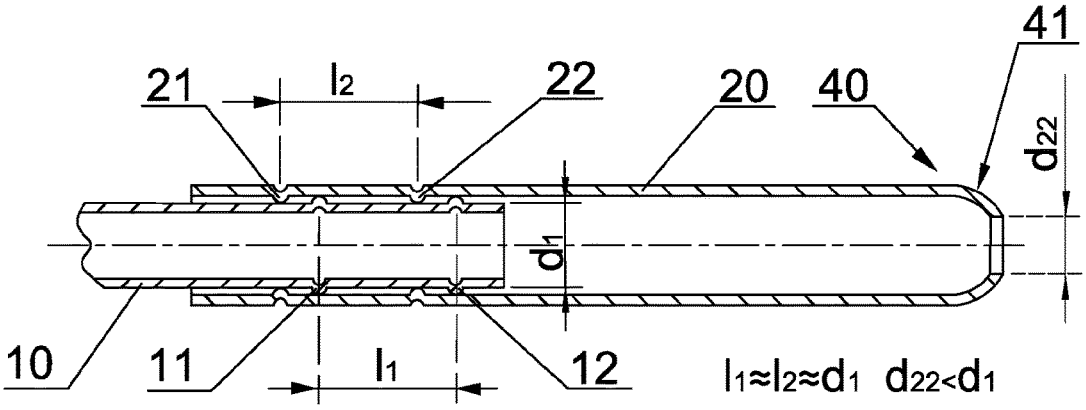
Figure 10B:
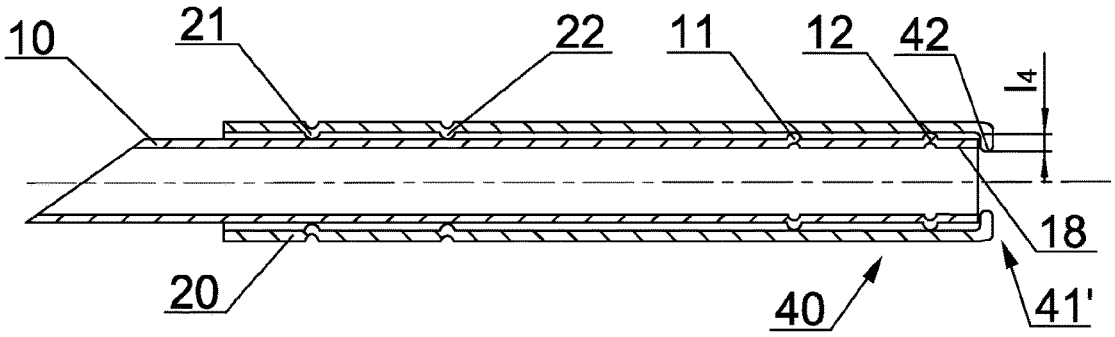
Figure 11A:
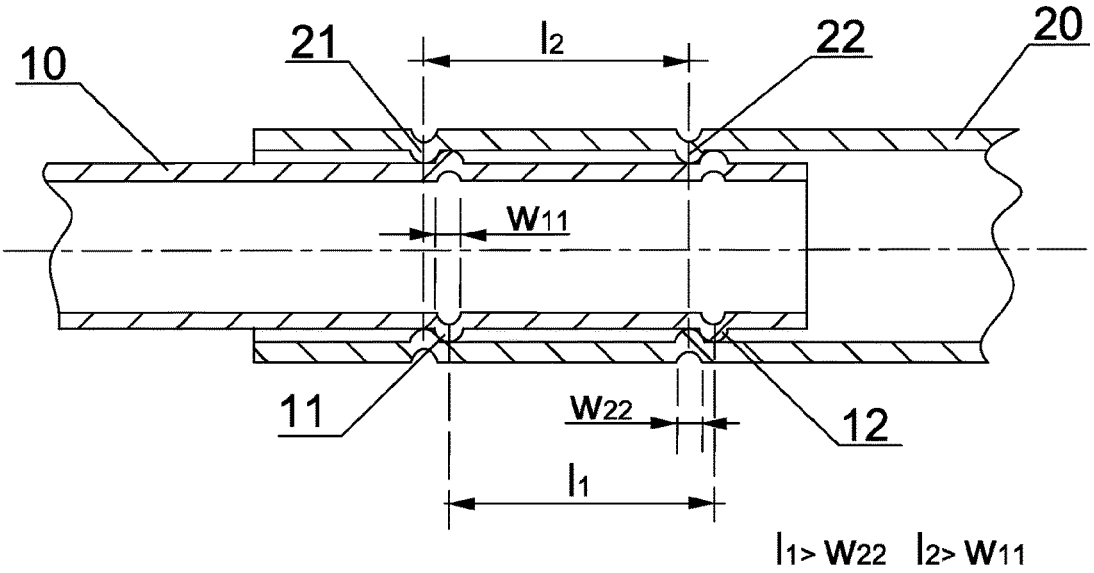
Figure 11B:
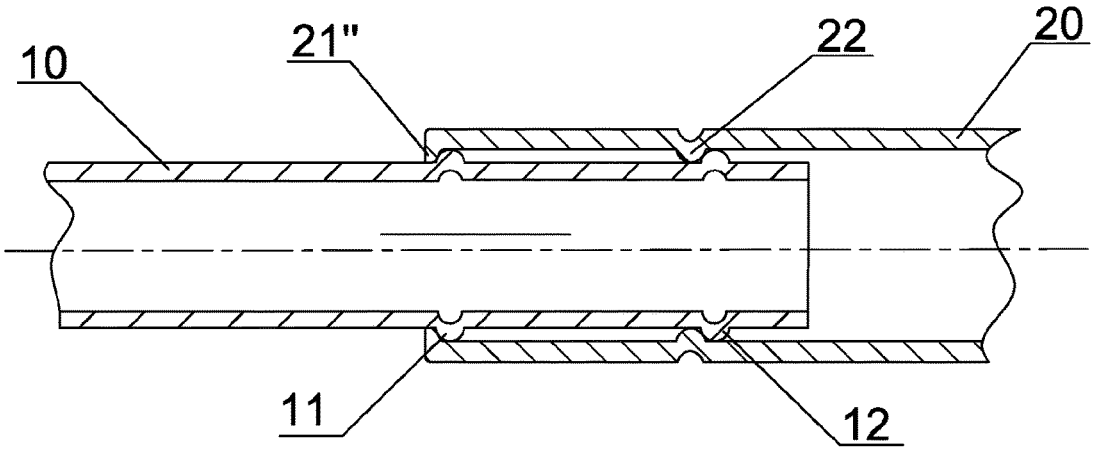
Figure 12A:
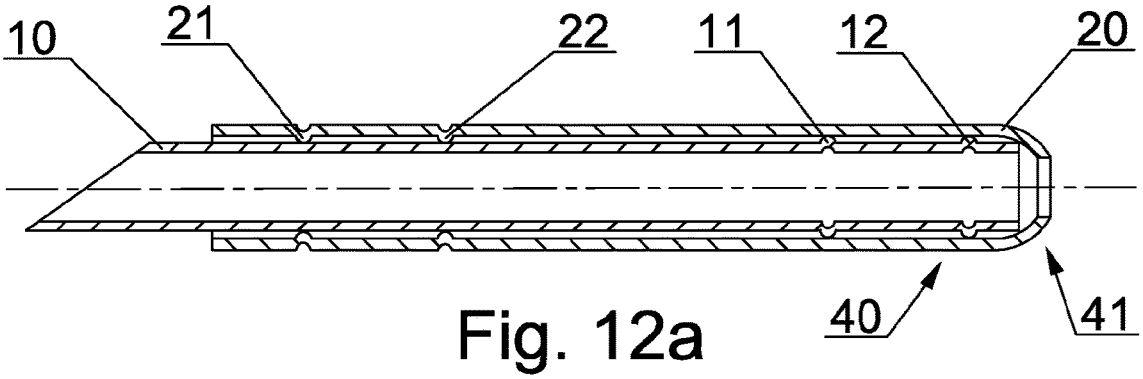

FIG. 5*a* shows a cross-section through a fragment of the telescopic straw with a locking element of the inner straw;

FIG. 5*b* shows a cross-section through a fragment of connection between the telescopic straw and a locking element of an outer straw;

FIG. 6*a* shows a cross-section through the inner straw of the telescopic straw according to another embodiment of the invention;

FIG. 6*b* shows a cross-section through the outer straw of the telescopic straw according to another embodiment of the invention;

FIG. 6*c* shows a cross-section through the connection of the telescopic straw according to another embodiment of the invention;

FIG. 7*a* shows a cross-section through the inner straw of the telescopic straw according to another embodiment of the invention;

FIG. 7*b* shows a cross-section through the inner straw of the telescopic straw according to another embodiment of the invention;

FIG. 8*a* shows the telescopic straw filled with liquid in a first working position;

FIG. 8*b* shows the telescopic straw filled with liquid in an intermediate working position;

FIG. 8*c* shows the telescopic straw filled with liquid in a second working position;

FIG. 9 shows the inner straw of the telescopic straw in another embodiment;

FIG. 10*a* shows the telescopic straw with a creased end according to the first embodiment of the invention;

FIG. 10*b* shows the telescopic straw with a creased end according to another embodiment of the invention;

FIG. 11*a* shows a cross-section through a fragment of the inner straw with a locking element of the telescopic straw;

FIG. 11*b* shows a cross-section through a fragment of the inner straw with the locking element of the telescopic straw according to another embodiment of the invention;

FIG. 12*a* shows the telescopic straw in its first configuration; and

Figure 12B:
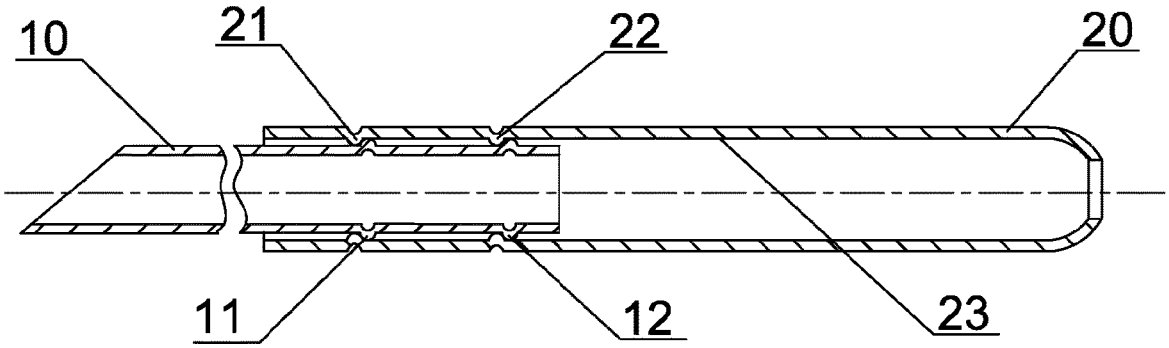

FIG. 12*b* shows the telescopic straw in the first configuration in the second embodiment.

Figure 1:
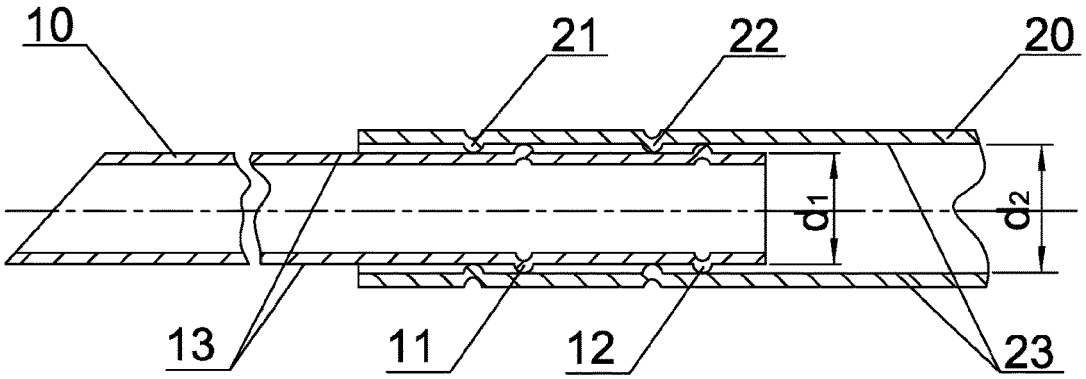
FIG. 1 shows a cross-section through a telescopic straw according to the invention.

FIG. 1 shows the first embodiment of a telescopic paper straw according to the invention. The telescopic straw substantially comprises a first straw 10 with a first outer diameter $d_1$ and a second straw 20 with a second inner diameter $d_2$. The straw 10 is situated coaxially with the straw 20 having the second diameter and at least partly inside the straw 20. A part of the straw 10 protrudes out of the straw 20 to facilitate pulling the first straw 10 out of the second straw 20.

The first straw 10 has at least two locking elements 11, 12 protruding from its outer surface 13, while the second straw 20 has at least two locking elements 21, 22 protruding inwards from its inner surface 23.

In FIG. 1, the straw according to the first embodiment of the invention was shown in an extended configuration in one of the working positions.

The straws 10 and 20 are spiral straws made of at least two paper bands, preferably of three paper bands, joined by means of an appropriate adhesive suitable for food applications. Such straws are biodegradable and do not permanently contaminate the environment.

Figure 2:
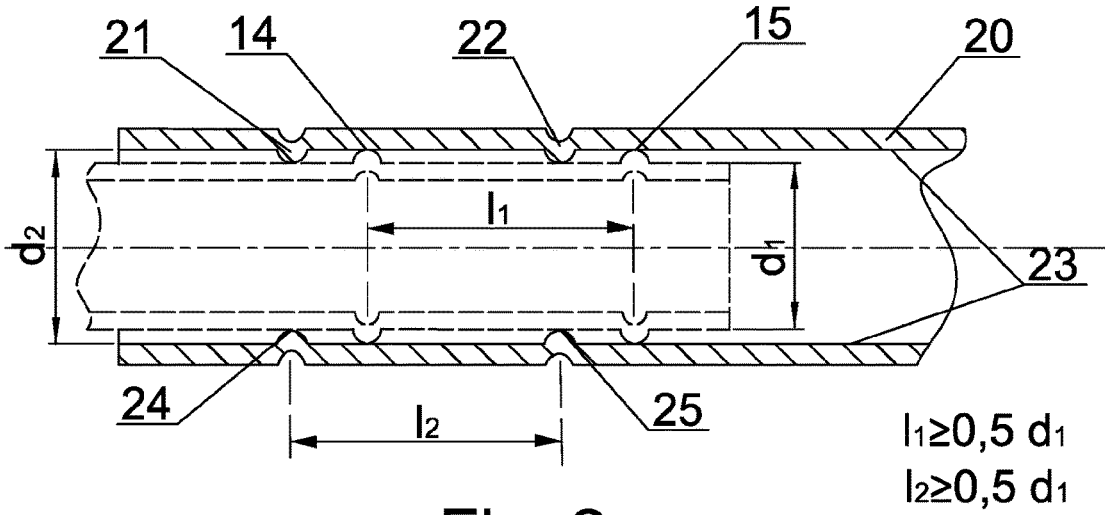
FIG. 2 shows a cross-section through a locking area of the telescopic straw.

FIG. 2 shows the second straw 20 and an outline of the first straw 10, in addition, locking elements 21 and 22 situated on the second straw 20 and protruding from the inner surface 23 of the straw 20 are clearly shown. The locking elements 21, 22 have the form of circumferential embosses directed towards the inside of the second straw 20. As the paper of which the straw is made is a material of cellulose fibres, it is susceptible to shaping, e.g. extrusion or embossing, whereas it retains a certain degree of elasticity, which has an advantageous effect on the sealing properties of the telescopic joint.

Traditional telescopic joints of paper straws are characterised by axial instability resulting from the bending torque that occurs when forces are applied perpendicularly to the axis of the extended straw 10. A solution to this problem is introducing at least two locking means situated at a distance of $l_1$, $l_2$ from each other, of at least half the diameter $d_1$ of the inner straw 10. It is advantageous to use a joint having at least two points of contact between the first straw 10 and the second straw 20. In the cross-sectional view, the places of contact have the form of points, while in a three-dimensional object they form circles around the circumference of the straws. In the embodiment shown, there are four contact points 14, 15, 24, 25 of the first straw 10 with the second straw 20. The contact points 14, 15, 24, 25 are formed by contacts of the locking elements 11, 12 of the first straw with the inner surface 23 of the second straw 20 and by contacts of the locking elements 21, 22 of the second straw 20 with the outer surface 13 of the first straw 10. Depending on dimensions of the straws, advantageous effects of axial stabilisation may be observed already for 2 mm spacing of the locking elements 21 and 22 on the straw 20, whereas in this case the straw 20 has an inner diameter of approx. 4 mm. Considerable spacing of the locking elements 21, 22 from each other on the straw 20, although it brings a further increase in the stabilisation effect, is not practical as it contributes to an increase in material consumption for the final product, thus an increase in the stabilisation area generates material costs which smooth away the advantageous stabilisation effects in an overall evaluation of the telescopic paper straw production process.

Figure 3:
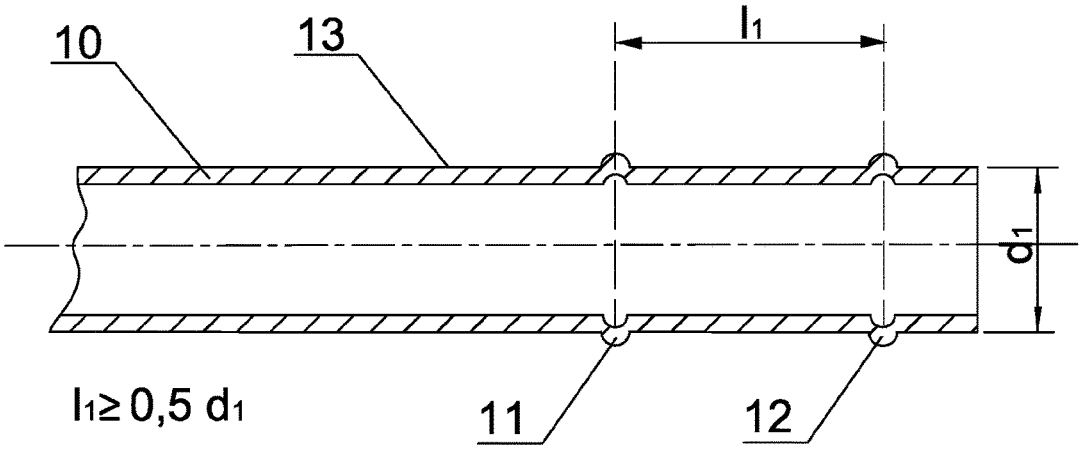
FIG. 3 shows a cross-section through an inner straw of the telescopic straw.

FIG. 3 shows the first straw 10 which is provided with the first locking elements 11 and the second locking elements 12 protruding from the outer surface 13 of the straw 10. The straw 10 works with the straw 20, therefore the arrangement of the locking elements on the straw 10 should substantially correspond to the arrangement of the locking elements on the straw 20. In the case of the straw 10 the locking elements 11 and 12 are arranged at a distance $l_1$ of at least half the diameter $d_1$ of the straw 10. It corresponds to the arrangement of the locking elements 21, 22 on the straw 20.

Figure 4:
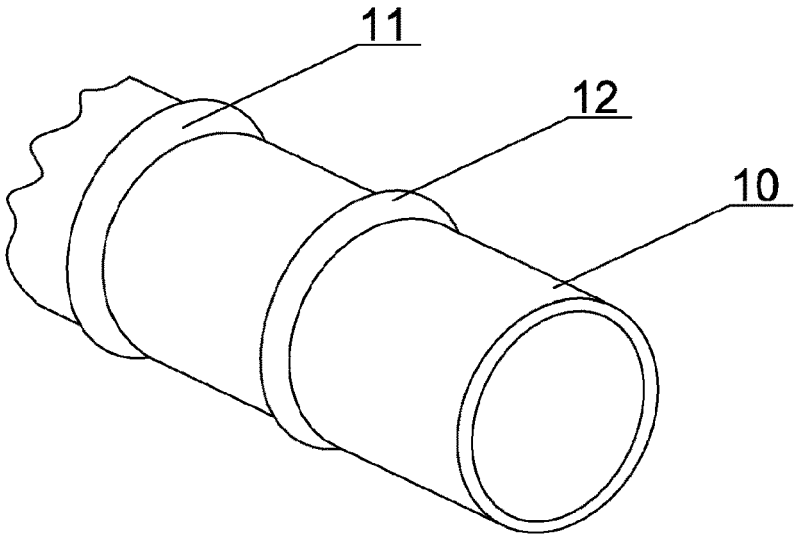
FIG. 4 shows the inner straw of the telescopic straw in an isometric view.

FIG. 4 shows the first straw 10 in an isometric view, in particular the shape of the locking elements 11, 12 is shown. In combination with the cross-section of FIGS. 5*a* and 5*b*, it can be seen that the locking elements 11 and 12 have the shape of embosses made substantially on the whole circumference of the straw 10. The locking elements 11 and 12 may have the form of embosses due to the use of paper as the material of which the telescopic straw is made. The paper, as a material composed of fibres, is susceptible to embossing. Despite the embossing, such material retains to some extent its natural elasticity, which allows to build the telescopic straw with the locking elements 11 and 12 maintaining the tightness of connection, and at the same time yielding when a certain limiting axial force is applied to the straw 10—which allows to extend the telescopic straw. The locking elements 11 and 12 having the form of embosses allow at the same time to keep the telescopic straw in an extended configuration as both complete extending and folding of the telescopic straw require the first limiting axial force to be applied again to the straw 10. The locking elements 21, 22 of the straw 20 have a similar structure, but the locking elements 21, 22 of the straw 20 are directed towards the inside of straw 20. FIG. 5*a* shows contact points 14, 15 of the locking elements 11,12 of the first straw 10 with the inner surface 23 of the second straw 20. Since in this embodiment the locking elements 11, 12 are substantially identical and form the same contact points, they were marked in the figure as the same element. The tightness of connection between the straws 10 and 20 is ensured by the elasticity of the material of the locking elements 11, 12 which impact the inner surface 23 of the straw 20 with their top part 16, 17 by forming the contact points 14, 15. A similar situation occurs in the case of the connection between the straws 10 and 20 shown in FIG. 5*b*. The top parts 26, 27 of the locking elements 21, 22 of the straw 20 form the contact points 24, 25 with the outer surface 13 of the straw 10 which ensure the support and the stability as well as the tightness of the joint.

FIGS. 6A and 6B show the first straw 10 and the second straw 20, respectively, together with the corresponding locking elements 11', 12' and 21', 22'. In this embodiment, the locking elements 11' and 12' have different heights $h_{11}$ and $h_{12}$, and the locking elements 21' and 22' have different heights $h_{21}$ and $h_{22}$, respectively. It should be also noted that $h_{11}>h_{12}$, and $h_{21}>h_{22}$, in another embodiment not shown in the figures, the relationship of heights of the locking elements is opposite, and $h_{11}<h_{12}$, and $h_{21}<h_{22}$.

FIG. 6*c* shows a joint of the straws 10 and 20 having the locking elements 11', 12' and 21', 22', respectively. The first contact point 24 is formed at the point of contact of the top part 26 of the locking element 21' of the straw 20 with the outer surface 13 of the straw 10. The second contact point 14 is formed at the point of contact of the top part 16 of the locking element 11' of the straw 10 with the inner surface 23 of the straw 20. In the case of the locking elements 12' and 22' whose height is smaller than the height of the locking elements 11' and 21', the contact points will be at the point 15' for the locking element 12', respectively, whereas the contact point 16' is formed at the point of contact of the top lateral part 17' with the top lateral part 27' of the locking element 22'. The locking elements 12" and 22' in this embodiment act more as a threshold informing the user, pulling the straw 10 out of the straw 20 to the working position, that the first locking element 21' has passed through the locking element 12', thus that the force used to pull the straw 10 out of the straw 20 needs to be reduced.

FIG. 7A shows the straw 10 with the locking elements 11 and 12 having the width $w_{11}$ and $w_{12}$, respectively, where $w_{11}>w_{12}$. In other embodiments not shown in the figures, the relationship of the width of the locking elements may be opposite, where $w_{11}<w_{12}$.

FIG. 7B shows an embodiment wherein the straw 10 is provided with the locking elements 11 and 12 having different widths and heights, whereas $h_{11}>h_{12}$ and $w_{11}>w_{12}$. In other embodiments, it is possible to use other combinations of height and width of the locking elements 11 and 12. The height and the width of the locking elements 21 and 22 formed on the straw 20 are subject to the same variability. With increasing width of the locking element, there is also an increase in the tightness of the telescopic joint and at the same time in the limiting axial force required to unfold the telescopic straw. Similar technical effects are observed when the height of the locking elements is increased.

FIG. 8*a* shows the telescopic straw in the extended configuration in the first working position, filled with liquid F. The first working position occurs when the locking element 11 is between the locking elements 21 and 22 of the straw 20. The locking element 12 of the straw 10 touches the inner surface 23 of the straw 20 at the point of contact 15 and creates an airtight barrier preventing the penetration of the liquid F into the space between the locking elements 11, 12. An additional barrier is formed by the locking element 22 of the straw 20 which contacts the outer surface 13 of the straw 10. The locking elements 11 and 21 of the straws 10 and 20, respectively, form subsequent barriers preventing the penetration of the liquid F through the telescopic joint and a lock against slipping out of the straw 10 from the straw 20 when pulling the straw 10 out of the straw 20 in the direction D. The spacing of the locking elements 11, 12 and 21 and 22 results in a limitation of the possibility of reciprocal displacement of the straws 10 and 20. In addition, as explained above, it increases the axial stability of the telescopic straw in the extended position, which also contributes to an increase in tightness of the joint as it limits the leakage of the liquid F through subsequent sealing barriers even if a significant force is applied to the pulled out end of the straw 10 in a direction perpendicular to its longitudinal axis, which results in the occurrence of a rotating moment having a tendency to unseal the tight barrier formed by the element 12 and also the element 22. Additional tight barriers are also formed by contacting lateral surfaces of the locking elements 12 and 22, as well as by contacting lateral surfaces of the locking elements 11 and 21. These additional barriers have an advantageous effect on increasing the tightness of the telescopic joint.

The telescopic straw in FIG. 8*b* is in an intermediate position between the first position and the second working position in the extended configuration. In the intermediate position, the locking element 11 of the straw 10 has been moved behind the locking element 21 of the straw 20 when pulling the straw 10 out in the direction D, and the locking element 12 is between the locking elements 21 and 22 of the straw 20. During further pulling of the straw 10 out of the outer straw 20, the telescopic straw passes to the second working position shown in FIG. 8*c*. In the second working position, the locking element 12 of the straw 10 is between two locking elements 21, 22 of the outer straw 20 as in the intermediate position described above. In addition, the lateral surfaces of the locking elements 12 and 21 come into contact with each other and form additional tight barriers. To ensure the rigidity of the telescopic straw, the stability and the tightness of the joint, the joint between the straws 10 and 20 should have at least two points of support. In this embodiment, in the second working position, there are three points of support at the contact points 14, 15 of the locking elements 11 and 12 with the inner surface 23 of the straw 20, and at the contact point 24 of the locking element 21 of the straw 20 with the outer surface 13 of the straw 10. In order to provide three points of support, it is important that the length $l_{22}$ of the outer straw 20 from its edge to the first locking element 21 is greater than or equal to the length $l_1$ of the distance between the two locking elements 11 and 12 of the straw 10. The same condition may also be fulfilled in a configuration not shown in the figure where the distance between the second locking element 12 of the straw 10 and its edge is greater than or equal to the length of the distance between the locking elements 21 and 22 of the straw 20.

FIG. 9 shows another embodiment of the telescopic straw, in particular FIG. 9 shows the straw 10 with the locking elements 11 and 12. It should be noted that the locking element 12 is situated at a distance of $l_{12}$ from the end of the straw 10, and the straw 10 has a diameter $d_1$. In the preferred embodiment, the distance $l_{12}$ is less than half the diameter of the straw 10. It is advantageous to minimise the distance $l_{12}$ due to the resulting material savings.

The straw 20, at the end 40 without the locking elements 21, 22, has an inner diameter $d_{22}$ smaller than the outer diameter $d_1$ of the straw 10. The diameter reduction has the form of a circumferential crease 41 and prevents the straw 10 from slipping out of the straw 20 through the end 40 when the telescopic straw is in the folded configuration in which most of the straw 10 is inside the straw 20. FIG. 10*a* shows an embodiment with the crease 41 wherein the end 40 of the straw 22 without the locking elements 21, 22 has a diameter $d_{22}<d_1$. In the embodiment shown in FIG. 10*a*, the locking elements 11, 12 of the straw 10 are spaced at the distance $l_1$, and the locking elements 21, 22 of the straw 20 are spaced at the distance $l_2$, where $l_1 \approx l_2 \approx d_1$. It was determined through tests that advantageous spacing of the locking elements for both elements 11 and 12 and elements 21, 22 is the distance corresponding to the diameter $d_1$ of the straw 10. This allows achieving a compromise between ensuring the axial stability of the telescopic joint and the material consumption associated with the formation of a stabilisation area in which both straws 10 and 20 are inserted into each other when the telescopic straw is in the extended configuration.

FIG. 10*b* shows another embodiment of the outer straw 20 whose end 40 has a minimum crease 41'. The distance $l_4$ corresponds to the length of the straw's 20 end section which has been creased inwards. The distance $l_4$ should extend radially inside the straw as deep as to come up at least to the inner surface of the 18 inner straw 10. FIG. 11*a* shows, in close-up, a fragment of the telescopic straw with clearly visible locking elements 11 and 12 of the straw 10 and locking elements 21, 22 of the straw 20. In FIG. 11*a*, the width of the locking element 11 is marked as $w_{11}$ and the width of the locking element 22 as $w_{22}$. The distance between the locking elements 11 and 12 is marked as $l_1$ and the distance between the locking elements 21 and 22 as $l_2$. In this embodiment, the distance $l_1$ is greater than the width $w_{11}$, and the distance $l_2$ is greater than the width $w_{22}$.

FIG. 11*b* shows the locking element 21" as a locking element formed at the end of the straw 20 as a crease or a collar, which allows using to the maximum the material of which the telescopic straw is made.

FIG. 12*a* shows the telescopic straw in the first configuration, i.e. in the folded (or transport) configuration. In this configuration, most of the straw 10 is situated inside the straw 20 and is held inside the straw by the crease 41 of the free end of the straw 40, i.e. the end at which the locking elements 21, 22 were not formed. In the folded configuration, the telescopic straw has a smaller overall length. It is also the configuration in which the telescopic straw is attached to the package of e.g. a beverage.

FIG. 12*b* shows the telescopic straw in the second configuration in the first working position. In this position, the straw 10 is pulled out of the straw 20 so that the locking elements 11 have been pushed through the locking elements 22 and are in the area between the locking elements 21 and 22. In the second working position, the lateral surfaces of the locking elements 11 and 21 and the locking elements 12 and 22 contact each other, which increases the tightness of the telescopic joint.

Puling the straw 10 out to the first working position requires the first limiting force to be applied axially. Passing through a clamp in the form of the locking elements 22 by the locking elements 11 is clearly perceptible to the user and allows reducing the axial force with which the straw 10 is pulled out below the threshold of the first limiting force and stabilising the telescopic straw in its first working position. If the locking elements 21, 22 and 11 and 12 are placed too close to each other, the user may not be able to reduce the axial force with which the straw 10 is pulled out below the threshold of the first limiting force, which will result in the locking element 11 passing through the locking elements 21. This will cause a loss of axial stability of the telescopic joint, but will not yet lead to unsealing because at least the seal resulting from the contact of the locking element 12 with the inner wall 23 of the straw 20 will be maintained. Only if pulling out the straw 10 with an axial force above the first limiting force is continued, the locking element 12 will pass through the locking element 21 and lead to inevitable unsealing of the telescopic joint when the locking element 12 slides out of the straw 20.

As regards FIGS. 12*a* and 12*b*, it should be noted that the straw 10 may also be passed through the crease 41 formed at the free end 40 of the straw 20 when it is pushed into the straw 20 by applying an axial force above the second limiting force to the straw 10. The ability to squeeze through the creased free end of the straw 20 is an important function increasing the safety of use of the telescopic straw, e.g. in the event of a fall when drinking a beverage through the telescopic straw, the telescopic straw will fold to the minimum length and minimise possible injuries.

A method of manufacturing and an apparatus for manufacturing the paper telescopic straw according to the invention were described in the European patent application EP20171882.2 the content of which is incorporated herein by reference.

The invention claimed is:

1. A telescopic paper drinking straw comprising:

a first straw (10) with a first outer diameter (d1), a second straw (20) with a second inner diameter (d2), whereas the first straw (10) with the first outer diameter (d1) is situated at least partly inside the second straw (20) with the second inner diameter (d2), coaxially with the second straw (20) with the second inner diameter (d2), wherein the second straw (20) has at least two locking elements (21, 22) protruding from an inner surface (23) of the second straw (20), characterised in that the first straw (10) has at least two locking elements (11, 12) protruding from an outer surface (13) of the first straw (10).

2. The telescopic paper drinking straw as in claim 1, wherein at least two locking elements (21, 22) protruding from the inner surface (23) of the second straw (20) are arranged at a distance (12) of at least half the diameter (d1) of the first straw (10).

3. The telescopic paper drinking straw as in claim 1, wherein at least two locking elements (11, 12) protruding from the outer surface (13) of the first straw (10) are arranged at a distance (l1) of at least half the diameter (d1) of the first straw (10).

4. The telescopic paper drinking straw as in claim 1, wherein a distance (11, 12) between the first (11, 12) and second locking elements (21, 22) on the first (10) and second straw (20), respectively, is at least 2 mm.

5. The telescopic paper drinking straw as in claim 1, wherein the locking elements (11, 12, 21, 22) have the form of ring-shaped embosses.

6. The telescopic paper drinking straw as in claim 1, wherein the locking elements (11, 12, 21, 22) have different height or width.

7. The telescopic paper drinking straw as in claim 1, wherein the locking elements (11, 12, 21, 22) are adapted to form a seal of a telescopic joint.

8. The telescopic paper drinking straw as in claim 1, wherein at least one locking element (11, 12) on the first straw (10) is situated at a distance (112) of at least half the diameter (d1) of the first straw (10) from one of its ends.

9. The telescopic paper drinking straw as in claim 1, wherein at least one locking element (21, 22) on the second straw (20) is situated at a distance (122) of at least half the diameter (d2) of the second straw (20) from one of its ends.

10. The telescopic paper drinking straw as in claim 1, wherein the inner diameter (d2) of the second straw (20) at one end is smaller than the outer diameter (d1) of the first straw (10).

11. The telescopic paper drinking straw as in claim 1, wherein at least two locking elements (11, 12) of the first straw (10) and at least two locking elements (21, 22) of the second straw (20) are arranged at a distance (11, 12) corresponding to the diameter (d1) of the first straw (10).

12. The telescopic paper drinking straw as in claim 1, wherein the distance (l1) between the locking elements (11, 12) of the first straw (10) is greater than a width (w22) of the locking element (21, 22) of the second straw (20), and the distance (12) between the locking elements (21, 22) of the second straw (20) is greater than a width (w11) of the locking element (11, 12) of the first straw (10).

13. The telescopic paper drinking straw as in claim 1, characterised by having two configurations, whereas in a first configuration the first straw (10) is substantially inside the second straw (20), and a part of the first straw (10) protrudes out of the second straw (20) allowing pulling the first straw (10) out of the second straw (20), while in a second configuration the first straw (10) is substantially pulled out of the second straw (20) so that at least one locking element (11, 12) of the first straw (10) is situated between the locking elements (21, 22) of the second straw (20), or at least one locking element (21, 22) of the second straw (20) is situated between the locking elements (11, 12) of the first straw (10).

14. The telescopic paper drinking straw as in claim 13, wherein in the second configuration, in a first working position, one of the locking elements (11, 12) of the first straw (10) is situated between the locking elements (21, 22) of the second straw (20), and in a second working position the second locking element (11, 12) of the first straw (10) is situated between the locking elements (21, 22) of the second straw (20).

15. The telescopic paper drinking straw as in claim 13, wherein in the second configuration, a lateral surface of at least one locking element (11, 12) of the first straw (10) protruding from the external surface of the first straw (10) is in contact with a lateral surface of at least one element protruding from the internal surface of the second straw (20).

16. The telescopic paper drinking straw as in claim 14, wherein in the second configuration, a lateral surface of at least one locking element (11, 12) of the first straw (10) protruding from the external surface of the first straw (10) is in contact with a lateral surface of at least one element protruding from the internal surface of the second straw (20).

* * * * *